US006853284B2

(12) United States Patent
Nagai et al.

(10) Patent No.: US 6,853,284 B2
(45) Date of Patent: Feb. 8, 2005

(54) HIGH-VOLTAGE TRANSFORMER

(75) Inventors: Tadao Nagai, Shiga-ken (JP); Yasunobu Saida, Omihachiman (JP); Toshihiko Suzuki, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/665,108

(22) Filed: Sep. 19, 2003

(65) Prior Publication Data

US 2004/0075524 A1 Apr. 22, 2004

(30) Foreign Application Priority Data

Oct. 1, 2002 (JP) ..... 2002-289017

(51) Int. Cl.[7] ..... H01F 27/02

(52) U.S. Cl. ..... 336/83; 336/183; 336/185; 336/232; 336/223; 336/192

(58) Field of Search ..... 336/83, 183, 223, 336/232, 192, 208, 185; 29/602.1, 605, 606

(56) References Cited

U.S. PATENT DOCUMENTS 5,138,545 A * 8/1992 Godawski ..... 363/68
5,524,334 A * 6/1996 Boesel ..... 29/605
6,075,431 A * 6/2000 Honma ..... 336/180
6,154,113 A * 11/2000 Murai ..... 336/198
6,587,026 B2 * 7/2003 Yeh et al. ..... 336/223

FOREIGN PATENT DOCUMENTS

JP 3182799 4/2001

* cited by examiner

*Primary Examiner*—Lincoln Donovan
*Assistant Examiner*—Jennifer A. Poker
(74) *Attorney, Agent, or Firm*—Keating & Bennett, LLP

(57) ABSTRACT

A high-voltage transformer includes a bobbin that holds a core at its center. This bobbin has eight winding grooves arrayed along the central axis of the core. A primary coil is wound around each of two outermost winding grooves with a predetermined number of turns. A secondary coil is wound around the six winding grooves near the center with a predetermined number of turns, which are distributed among these winding grooves. The cathode of a diode is connected through a terminal to one end of the secondary coil where the winding starts, while the anode of another diode is connected through another terminal to the other end of the secondary coil where winding ends.

10 Claims, 4 Drawing Sheets

HIGH-VOLTAGE TRANSFORMER

BACKGROUND OF THE INVENTION

1. Field of the Invention

The present invention relates to high-voltage transformers.

2. Description of the Related Art

In general, copy machines and printers use high-voltage power supplies. Such devices include a high-voltage transformer with a high-voltage output on the order of DC 10 KV.

For example, Japanese Patent No. 3182799 discloses a high-voltage transformer of this type. This high-voltage transformer includes a transformer section and a voltage multiplier-rectifier circuit section. FIG. 4A is a sectional view showing bobbins of the transformer section. FIG. 4B is a circuit diagram showing pulses generated by the high-voltage transformer. Referring to FIG. 4A, a primary-coil bobbin 21 has a hole for holding a core in its center and two flanges arrayed along the central axis. These two flanges form a winding groove 22. One of the flanges has two terminals 23. A concentric secondary-coil bobbin 24 surrounds the periphery of the primary-coil bobbin 21. The secondary-coil bobbin 24 has five flanges arrayed along the central axis. These five flanges form four winding grooves 25. The outermost flanges each have a terminal 26. Both bobbins have nearly the same length. The transformer section includes the primary-coil bobbin 21, the secondary-coil bobbin 24, a primary coil, a secondary coil, and the core.

Referring to FIG. 4B, a high-voltage transformer 30 has a voltage multiplier-rectifier circuit section, which is a Cockcroft-Walton circuit including diodes D21 and D22 and capacitors C21 and C22. This voltage multiplier-rectifier circuit section is connected to both ends of a secondary coil S21. The cathode side of the diode D21 is a high-voltage output. In this high-voltage transformer 30, a primary coil P21 is connected to a drive circuit (not shown in the drawing) that includes a switching element and operates at a predetermined frequency. This drive circuit detects the output voltage and current and turns the switching element on/off to operate with constant voltage and current.

A positive pulse W21 is generated in the primary coil P21 by the drive circuit, while a positive pulse W22 is generated in the second coil S21. The amplitude of the positive pulse W22 depends on the turn ratio of the high-voltage transformer 30. The voltage multiplier-rectifier circuit section rectifies and multiplies this positive pulse W22 to provide a high-voltage output.

Miniaturization of copy machines and printers, which require a more compact, less expensive high-voltage transformer, has recently been advancing. Conventional high-voltage transformers unfortunately have a large number of components, making it difficult to miniaturize them to reduce their cost. The present inventors examined a single bobbin holding a primary coil and a secondary coil. This bobbin resulted in a loose connection between the two coils. In addition, in this bobbin, the secondary coil generates a pulse having the same amplitude as in a conventional bobbin, thus failing to reduce the distributed capacitance. As a result, the bobbin exhibits poor high-voltage output characteristics, such as load characteristics and frequency characteristics.

SUMMARY OF THE INVENTION

In order to overcome the problems described above, preferred embodiments of the present invention provide an inexpensive, compact high-voltage transformer having satisfactory high-voltage output characteristics.

According to a preferred embodiment of the present invention, a high-voltage transformer includes a core, a bobbin having a hole for holding the core and at least three winding grooves arrayed along the central axis, primary coils wound around outermost winding grooves among these winding grooves, and a secondary coil wound around a winding groove other than the outermost winding grooves, the secondary coil being connected to diodes at both ends.

In this high-voltage transformer, the diameter of the hole for holding the core preferably increases from the center to both ends of the secondary coil.

According to preferred embodiments of the present invention, the secondary coil connected to the diodes at both ends allows a reduction of the distributed capacitance in the secondary coil. In addition, the primary coils disposed on both sides of the secondary coil provide a close coupling between the primary and secondary coils. This enhances the high-voltage output characteristics and minimizes undesirable harmonics. Moreover, such a configuration allows a reduction in the number of components and processing steps. Therefore, preferred embodiments of the present invention provide an inexpensive, compact high-voltage transformer having satisfactory high-voltage output characteristics. Furthermore, the hole for holding the core is tapered, having advantages such as enhanced withstand voltage.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1A:
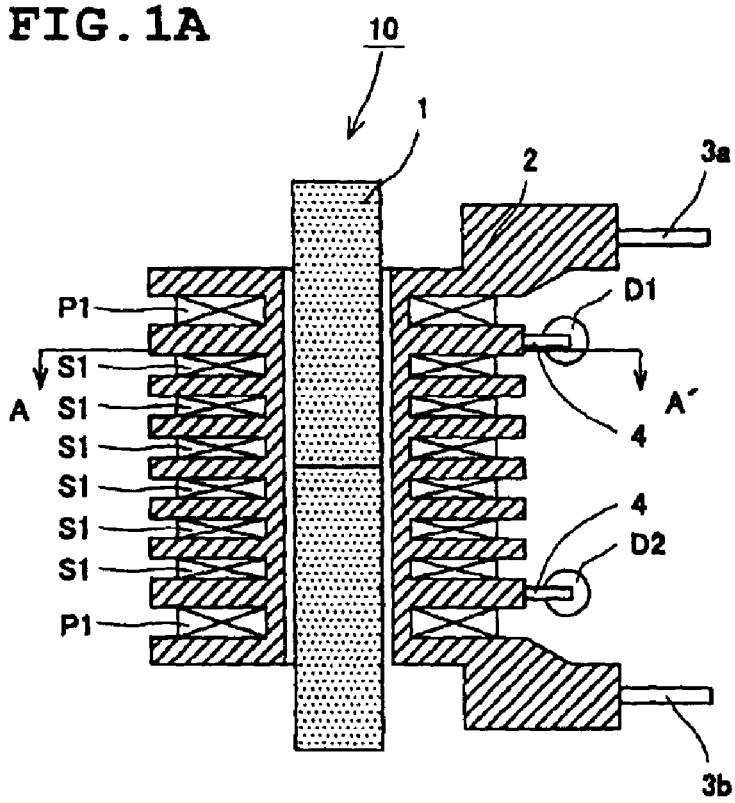
FIG. 1A is a schematic vertical sectional view of a high-voltage transformer according to a first preferred embodiment of the present invention.
Figure 1B:
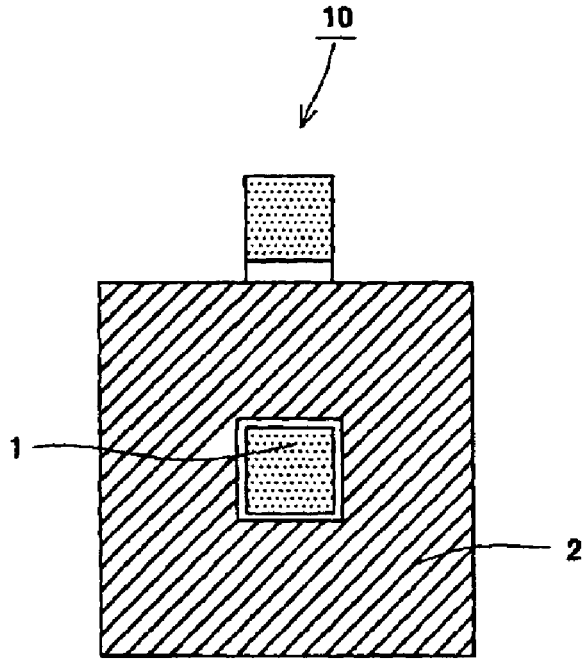
FIG. 1B is a schematic horizontal sectional view of the high-voltage transformer according to the preferred embodiment of the present invention shown in FIG. 1A.
Figure 2:
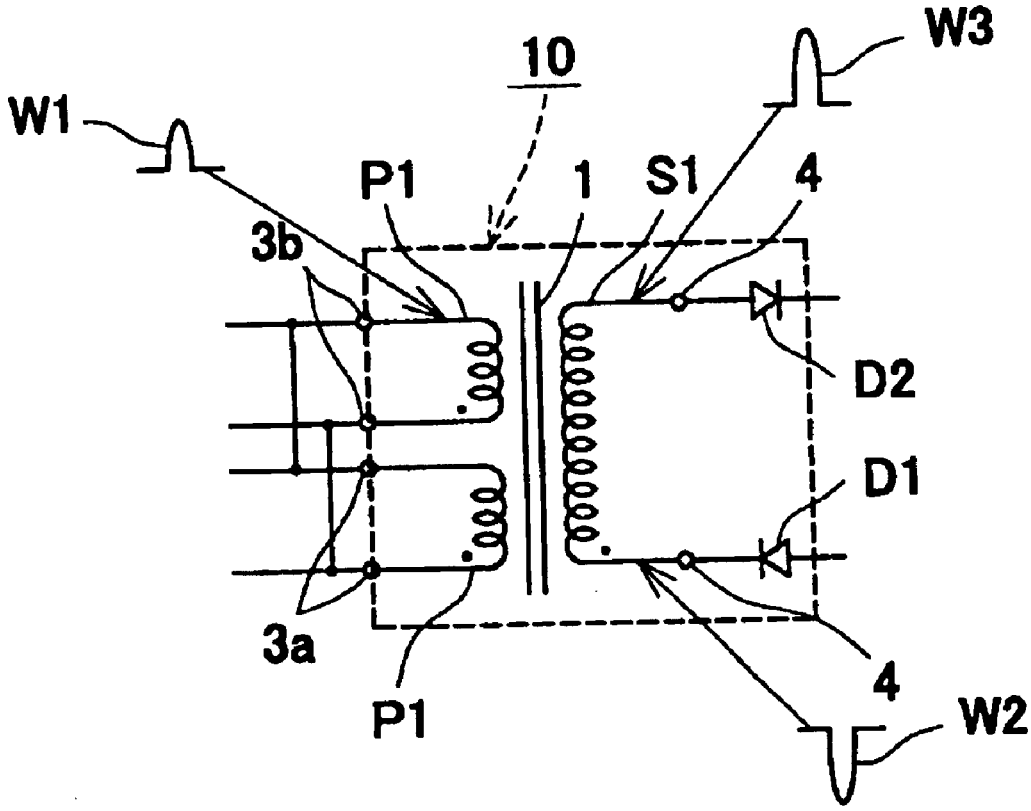
FIG. 2 is a circuit diagram showing generated pulses according to a preferred embodiment of the present invention.

A first preferred embodiment of the present invention will now be described with reference to FIGS. 1A, 1B, and 2. FIG. 1A is a vertical sectional view of a high-voltage transformer; FIG. 1B, is a horizontal sectional view taken along a line A–A' in FIG. 1A; and FIG. 2 is a circuit diagram showing pulses generated by the high-voltage transformer. Referring to FIGS. 1A, 1B, and 2, a high-voltage transformer 10 includes a bobbin 2 that holds a core 1 in its center. This core 1 is, for example, a horseshoe ferrite core with a substantially square sectional area of, for example, approximately 4 mm by 4 mm. The bobbin 2 is made of, for example, polybutylene terephthalate (PBT). This bobbin 2 has a hole for holding the core 1. The hole has a substantially square horizontal section and a uniform vertical section over the full length. The bobbin 2 has, for example, nine flanges arrayed along the central axis of the core 1. The nine flanges define eight winding grooves. For example, the outermost winding grooves preferably have a width of about 1.5 mm, and the six winding grooves near the center preferably have a width of about 0.6 mm. The external shape of the flanges is substantially square having dimensions of, for example, about 13 mm by 13 mm. Bases are disposed on the outermost flanges. One base has two terminals 3*a* (one of them is not shown in the drawing), while the other has two terminals 3*b* (one of them is not shown in the drawing). The flanges adjacent to these outermost flanges have terminals 4.

A primary coil P1 is wound around each of the outermost winding grooves with a predetermined number of turns. One of the primary coils P1 is connected to the two terminals 3*a* at both ends, while the other is connected to the two terminals 3*b* at both ends. These primary coils P1 are made of, for example, a copper wire with a diameter of about 0.15 mm.

A secondary coil S1 is wound around the six winding grooves near the center with a predetermined number of turns, which are distributed among these winding grooves. This secondary coil S1 is made of, for example, a copper wire with a diameter of about 0.04 mm. The secondary coil S1 is connected to diodes D1 and D2 at both ends. Specifically, the cathode of the diode D1 is connected through the terminal 4 to one end of the secondary coil S1 where winding starts, while the other end of the secondary coil S1 where winding ends is connected through the terminal 4 to the anode of the diode D2. The cathode side of the diode D2 is a high-voltage output on the order of approximately DC 2 KV to 10 KV. This high-voltage transformer 10 includes a synthetic resin case (not shown in the drawing) that accommodates the bobbin 2, the primary coils P1, the secondary coil S1, and the diodes D1 and D2, except for the core 1. This case is filled with, for example, epoxy resin to ensure a sufficient withstand voltage for and between the accommodated members.

In the high-voltage transformer 10, the primary coils P1 are connected to a drive circuit (not shown in the drawing) that includes a switching element and operates at, for example, about 59 KHz. This drive circuit detects the output voltage and current and turns the switching element on/off to operate with constant voltage and current.

Referring to FIG. 2, in the high-voltage transformer 10, the two primary coils P1 are connected in parallel at a drive circuit board. The drive circuit generates a positive pulse W1 in the primary coils P1. In the secondary coil S1, a negative pulse W2 is generated at the cathode side of the diode D1, while a positive pulse W3 is generated at the anode side of the diode D2. Therefore, a pulse having an amplitude equal to the sum of that of the negative pulse W2 and that of the positive pulse W3 is generated between both ends of the secondary coil S1. For the same high-voltage output, the two generated pulses W2 and W3 are about half as large as that in a conventional high-voltage transformer. The potentials of the two generated pulses W2 and W3 are lower around the center and become higher toward the two ends of the secondary coil S1.

According to the first preferred embodiment of the present invention, the secondary coil connected to diodes at both ends generates a pulse about half as large as that in a conventional high-voltage transformer, leading to a reduction of the distributed capacitance. In addition, the primary coils disposed at both sides of the secondary coil provide a close coupling between the primary and secondary coils, allowing higher-order resonance. Moreover, such primary coils may provide positive and negative pulses with a uniform waveform by, for example, slightly changing the distribution of turns at the side of the positive or negative pulse. This enhances the high-voltage output characteristics such as load characteristics and frequency characteristics and minimizes harmonics which result in noise. Furthermore, such a configuration requires only one bobbin and does not require a voltage multiplier-rectifier circuit, leading to a reduction in the number of components and processing steps. Therefore, this preferred embodiment of the present invention provides an inexpensive, compact high-voltage transformer having satisfactory high-voltage output characteristics, which allow simplification of the drive circuit that controls the output voltage and current.

Figure 3A:
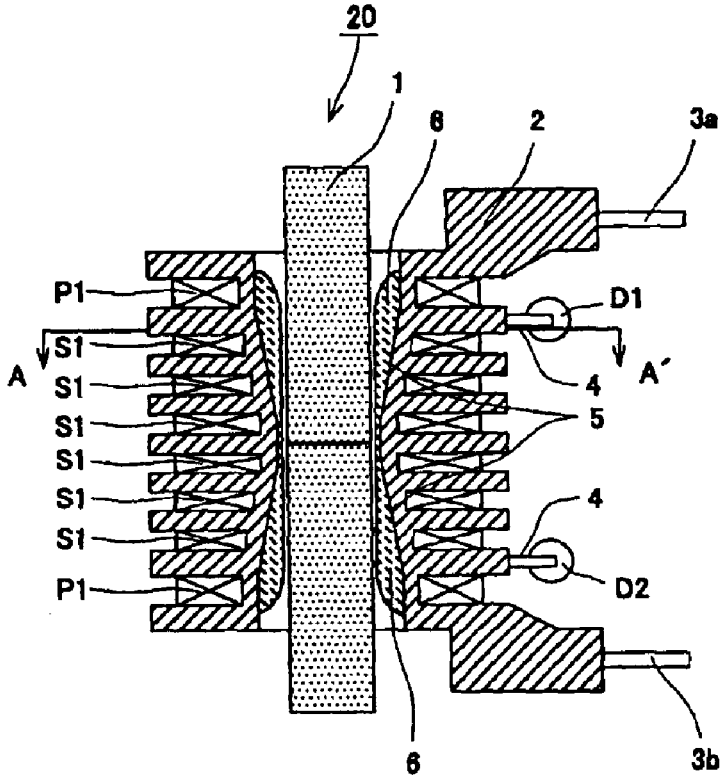
FIG. 3A is a schematic vertical sectional view of a high-voltage transformer according to a second preferred embodiment of the present invention.
Figure 3B:
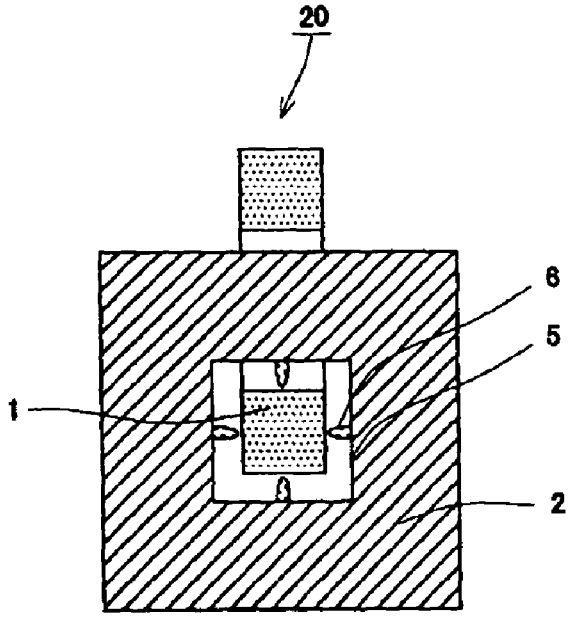
FIG. 3B is a schematic horizontal sectional view of the high-voltage transformer according to the second preferred embodiment of the present invention shown in FIG. 3A.
Figure 4A:
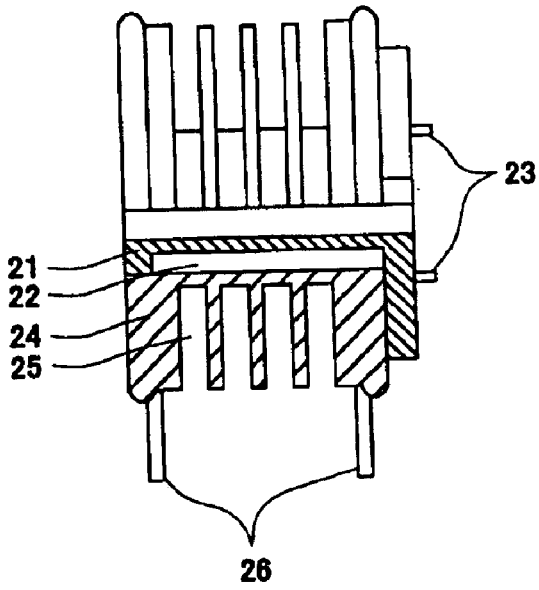
FIG.4A PRIOR ART
FIG. 4A is a schematic vertical sectional view of bobbins in a conventional high-voltage transformer.
Figure 4B:
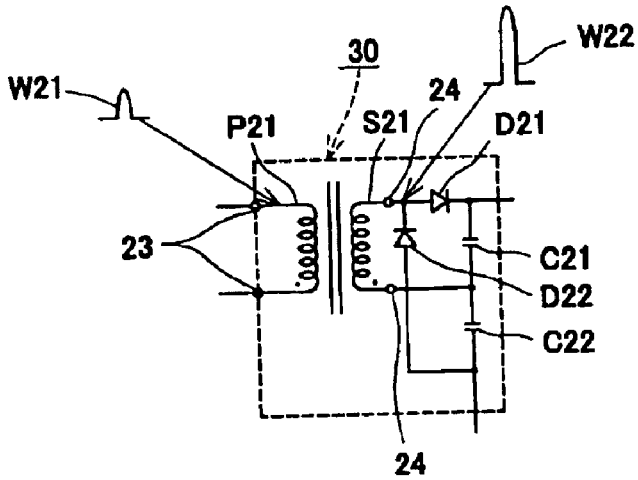
FIG.4B PRIOR ART
FIG. 4B is a circuit diagram showing pulses generated by the conventional high-voltage transformer.

Next, a second preferred embodiment of the present invention will now be described with reference to FIGS. 3A and 3B. FIG. 3A is a vertical sectional view of a high-voltage transformer; FIG. 3B is a horizontal sectional view taken along a line A–A' in FIG. 3A. In FIGS. 3A and 3B, the same elements as in FIGS. 1A and 1B are represented by the same reference numerals as in FIGS. 1A and 1B and will not be described. Also, a circuit and generated pulses, the same as in FIG. 2, will not be illustrated.

Referring to FIGS. 3A and 3B, the bobbin 2 in a high-voltage transformer 20 is different from that in the high-voltage transformer 10 in the vertical section of the hole for holding the core 1. In the second preferred embodiment, this hole has taper sections 5 having diameters that increase from the center to both ends of the secondary coil S1, and substantially cylindrical sections following the taper sections 5. Therefore, the winding grooves near the center are deeper than those near both ends. In addition, four ribs 6 protrude from the inner surfaces of the bobbin 2 toward the surfaces of the core 1. These ribs 6 extend to the core 1 to hold the core 1 firmly.

The second preferred embodiment of the present invention has the same advantages as the first preferred embodiment. In addition, the second preferred embodiment provides a larger distance between windings at the bottom of the winding grooves and the core at a higher potential section of the secondary coil. This enhances the withstand voltage and reduces the distributed capacitance between the windings and the core. Furthermore, the space between the bobbin and the core facilitates heat dissipation of the core and the primary coil, which generate a large amount of heat.

The above-described preferred embodiments are exemplified by a bobbin and core with a substantially square horizontal section; however, the present invention is not limited to these preferred embodiments. The horizontal section may be of another shape, such as a circle or other suitable shape. The winding grooves used for the secondary coil, turns of the secondary coil, and turns distributed among the winding grooves depend on the required characteristics.

The present invention is not limited to each of the above-described preferred embodiments, and various modifications are possible within the range described in the claims. An embodiment obtained by appropriately combining technical means disclosed in each of the different preferred embodiments is included in the technical scope of the present invention.

What is claimed is:

1. A high-voltage transformer comprising:

a core having a central axis;

a bobbin having a hole for holding the core and at least three winding grooves arrayed along the central axis of the core;

primary coils wound around outermost winding grooves among said at least three winding grooves; and a secondary coil wound around a winding groove other than the outermost winding grooves, the secondary coil being connected to diodes at both ends;

wherein the winding grooves near the center of the core are deeper than the winding grooves located near both ends of the core.

2. A high-voltage transformer according to claim 1, wherein the diameter of the hole for holding the core increases from a center thereof to both ends of the secondary coil.

3. A high-voltage transformer according to claim 1, wherein the core is a horseshoe-shaped ferrite core with a substantially square sectional configuration.

4. A high-voltage transformer according to claim 1, wherein a plurality of flanges are arrayed along the central axis of the core to define the at least three winding grooves.

5. A high-voltage transformer according to claim 4, wherein nine of the flanges and eight of the winding grooves are provided.

6. A high-voltage transformer according to claim 4, wherein the flanges are substantially square shaped.

7. A high-voltage transformer according to claim 4, further comprising bases disposed on two outermost flanges of the plurality of flanges.

8. A high-voltage transformer according to claim 7, wherein the bases include terminals disposed thereon.

9. A high-voltage transformer according to claim 1, wherein a vertical section of the hole in the bobbin for holding the core includes taper sections that increase from a center to both ends of the secondary coil.

10. A high-voltage transformer according to claim 1, wherein a plurality of ribs are arranged to protrude from inner surfaces of the bobbin toward surfaces of the core.

* * * * *